US005427453A

United States Patent [19]

Cloessner

[11] Patent Number: 5,427,453

[45] Date of Patent: Jun. 27, 1995

[54] DUAL OPENING CARRYING BAG

[76] Inventor: Jacob E. Cloessner, 17106 General Pickett Dr., Baton Rouge, La. 70817

[21] Appl. No.: 69,971

[22] Filed: May 28, 1993

[51] Int. Cl.[6] ..... B65D 30/22

[52] U.S. Cl. ..... 383/38; 383/41; 190/109; 190/111

[58] Field of Search ..... 383/2, 38, 39, 41; 190/103, 109, 111; 150/112, 117

[56] References Cited

U.S. PATENT DOCUMENTS

| | | | |
|---|---|---|---|
| 2,078,624 | 4/1937 | Wolff | 383/2 |
| 2,429,856 | 7/1945 | Vasquez . | |
| 2,437,149 | 9/1945 | Baxter . | |
| 2,497,325 | 2/1950 | Scherba | 383/41 X |
| 2,802,501 | 12/1956 | Stember . | |
| 3,245,448 | 10/1963 | Rea . | |
| 3,340,969 | 9/1967 | Rothberg | 383/4 X |
| 4,078,595 | 3/1978 | Mittelmann | 383/2 X |
| 4,236,615 | 12/1980 | Ginat | 190/103 X |
| 4,693,344 | 9/1987 | Shuler . | |
| 5,050,998 | 9/1991 | Wachtel . | |
| 5,288,150 | 2/1994 | Bearman | 383/38 |

FOREIGN PATENT DOCUMENTS

| | | | |
|---|---|---|---|
| 0487375 | 5/1992 | European Pat. Off. | 383/38 |
| 0794125 | 4/1958 | United Kingdom | 383/41 |

*Primary Examiner*—Allan N. Shoap
*Assistant Examiner*—Jes F. Pascua
*Attorney, Agent, or Firm*—William D. Kiesel; Robert C. Tucker

[57] ABSTRACT

A compartmentalized carrying bag is provided comprising a containment structure formed from wall members whose interior surfaces form a sealable interior cavity having a fixed maximum volume. The cavity is divided into separate sealable chambers by a dividing member attached to the interior surfaces. Each separate chamber is accessible from outside the containment structure by separate sealable access portals. The dividing member is structured to permit the volume of each separate chamber to vary from approximately the fixed maximum volume to approximately zero, wherein at all times the sum of the volumes of the separate chambers is equal to approximately the fixed maximum volume.

7 Claims, 9 Drawing Sheets

DUAL OPENING CARRYING BAG

BACKGROUND OF THE INVENTION

The present invention relates generally to carrying bags having at least two separate cavities and more specifically to carrying bags having at least two separate cavities at least one of which is sealable, variable in volume and includes a separate, sealable access portal.

Carrying bags have been known and used for many years. They minimally consist of a shell or containment structure, comprising a sealable chamber or chambers for receiving items for transport; and a carrying device, such as a strap or handle, attached to the exterior of the containment structure for facilitating the grasping and carrying of the bag. Sealable in this context means closeable such that in normal use the items carried within the bag will remain there when the bag is sealed. Such bags are generally used as luggage for transporting clothing and personal belongings on trips between locations. If the trip is an extended one, or if the activities to be engaged in require it, several changes of clothing may be necessary. These clothing changes create a dirty laundry transportation and storage problem. Soiled clothes, often containing moisture and bacteria, can have unpleasant odors, easily transported by the air. Because of the easy transferability of these odors, it is important to isolate the clean clothing from the soiled clothing throughout the trip.

The problem of storing and transporting the soiled clothing can be solved by carrying a separate bag. However, this solution requires the traveller to carry an additional carrying bag. Extra luggage can be inconvenient for business travellers using common carriers; since, often only a fixed number of carry-on items are allowed. If the traveller is required to carry an additional bag for soiled clothing he may be prevented from carrying on other items, such as a lap-top computer, which could make the traveler's transit time more productive. It is desirable, therefore, to limit the number of bags carried on a trip.

If an additional bag is not used, the carrying bag must have separate compartments for the clean and soiled clothing. Since the carrying bag must carry the entire quantity of clothing in either the clean or soiled condition, the total volume of the carrying bag must equal twice the volume of clothing to be taken on the trip. This increased volume requires the carrying bag to have a larger containment structure; which can be inconvenient for a traveller in a crowded airport or airplane, or to a person with limited trunk space in his auto. In addition, above-the-seat and side-cabinet luggage storage on common carriers is usually volume restricted. It is desirable therefore to limit the volume of the carrying bag to the minimum required to transport a given quantity of clothing in either the clean or dirty condition.

SUMMARY OF THE INVENTION

Therefore it is an object of the present invention to provide a carrying bag wherein there is provided at least two separate compartments which are substantially sealed from moisture and air transfer between themselves.

It is a further object of this invention to provide a compartmentalized carrying bag capable of containing a fixed maximum volume wherein the maximum volume of each separate compartment is at least equal to the maximum volume of the containment structure of the carrying bag.

Accordingly, a compartmentalized carrying bag is provided comprising a containment structure having an interior surface forming a sealable interior cavity which has a fixed maximum volume. The containment structure includes a plurality of separate, sealable access portals extending through the containment structure and connecting the sealable interior cavity to the exterior of the containment structure. A flexible dividing member is fixed to the interior cavity surface to form a plurality of separate chambers within the interior cavity. Each of the separate chambers is accessible through at least one of the sealable access portals. The flexible dividing member is adapted such that the volume of each of the separate chambers is variable from about zero to approximately the fixed maximum volume of the sealable interior cavity of the containment structure and so that the sum of the volumes of the chambers equals the volume of the sealable interior cavity.

Alternatively, a compartmentalized carrying bag is provided comprising a containment structure having an interior surface forming a sealable interior cavity which has a fixed maximum volume. The containment structure includes a plurality of separate, sealable access portals extending through the containment structure and connecting the sealable interior cavity to the exterior of the containment structure. A flexible dividing member is fixed to the interior cavity surface to form a plurality of separate chambers within the interior cavity. Each of the separate chambers is accessible through at least one of the sealable access portals. The flexible dividing member is extendable through at least one of the sealable access portals and adapted such that the volume of each of the separate chambers is variable from about zero to a volume greater than the fixed maximum volume of the sealable interior cavity when the flexible dividing member is extended through one of the sealable access portals.

PREFERRED EMBODIMENTS OF THE INVENTION

Figure 1:
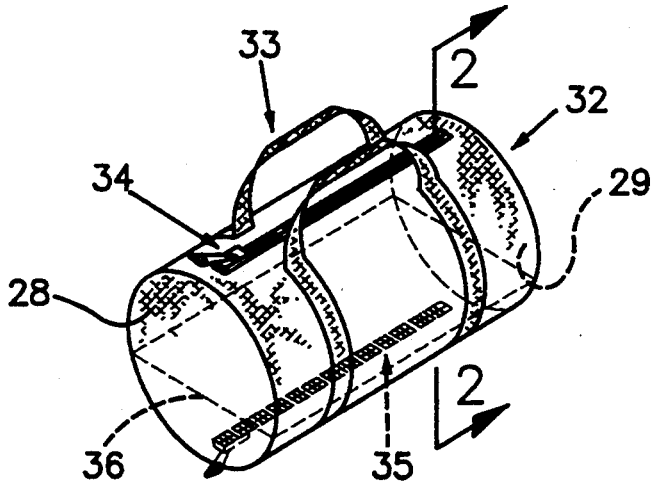
FIG. 1 is a perspective view of a bag embodying the present invention.
Figure 1A:
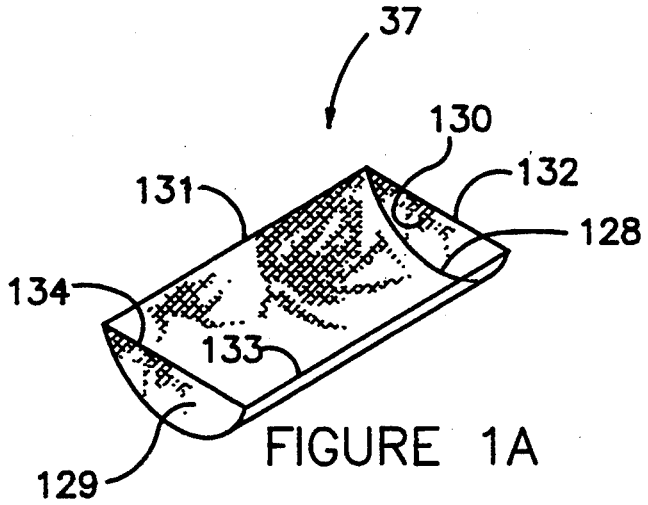

As shown in FIG. 1, a preferred embodiment of the present invention appears outwardly to be a common cylindrically shaped canvas bag. The bag consists of a containment structure, generally referred to by the numeral 32; two zippered access portals, generally referred to by the numerals 34 and 35; a handle, generally referred to by the numeral 33; and a flexible dividing member, generally referred to by the numeral 37.

Figure 2:
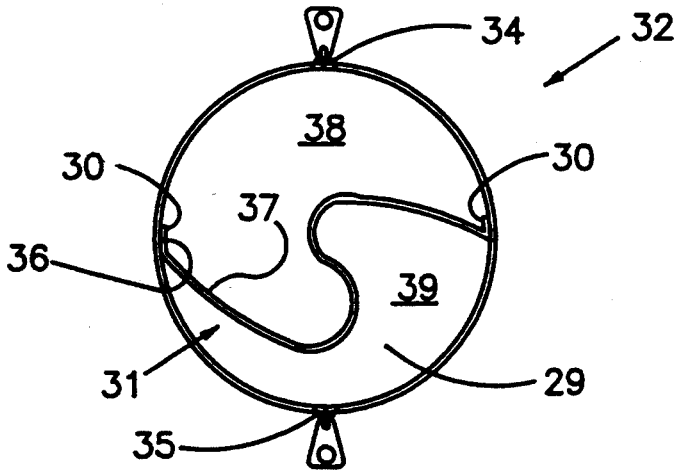
FIG. 2 is a sectional view on the line 2—2 of FIG. 1.

The containment structure of the bag, shown in FIG. 2, is constructed of canvas and has equal, substantially circular end-sections 28 and 29. Flexible dividing member 37 is substantially rectangular in this embodiment of the invention. The length of flexible dividing member 37 is selected to be longer than half the length of circumferential midline 36 illustrated in FIG. 1 to permit the flexible dividing member to be sewn or glued to the interior surface of containment structure 32 and still permit both chambers 38 and 39 to be expandable to approximately the volume of cavity 31. If sewn, a preferred length would be approximately two inches longer than one half the length of midline 36. The width of flexible dividing member 37 is selected to be longer than one half the circumference of either equal diameter, circular end-section 28 or 29 to permit chambers 38 and 39 to be expandable to approximately the volume of cavity 31. Flexible dividing member 37 is gathered along edge 30 and attached to the interior surface of interior cavity 31 along circumferential midline 36 creating separate chambers 38 and 39. Chamber 38 is accessible through zipper 35; chamber 39 is accessible through zipper 34. In a more preferred embodiment flexible dividing member 37 is constructed of vinyl, leather, rubberized canvas or other similar material to prevent moisture and/or odor transfer between the separate chambers and is large enough to allow either of separate chambers 38 and 39 to be expandable to at least the volume of interior cavity 31. To prevent odor transfer between the chambers the flexible dividing member should be constructed of material that prevents air from traveling from one chamber to the other chamber. Material which is substantially impervious to gas when the pressure differential between the chambers is zero is preferred.

In this configuration both chambers 38 and 39 have a variable volume that ranges from about zero to approximately the fixed maximum volume in a manner such that the sum of the volumes will be equal to the volume of interior cavity 31. Thus, in use, chamber 38 could initially be filled with clean clothes up to a volume of the fixed maximum volume. As clean clothes are removed and used, they can be placed in the second chamber 39; separate and apart from the first chamber 38. The flexible dividing member 37 allows the first chamber 38 to become smaller to accommodate the used clothes placed into second chamber 39. This process can continue until all of the clean clothes in the first chamber 38 have been removed and placed in the second chamber 39.

Figure 19:
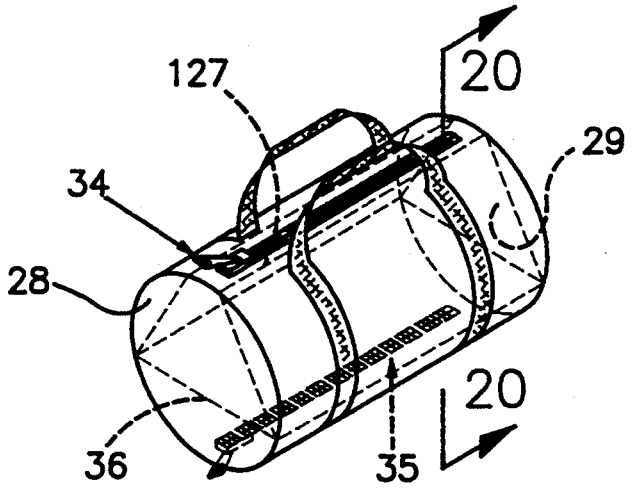
FIG. 19 is a perspective view of an embodiment of the present invention.
Figure 20:
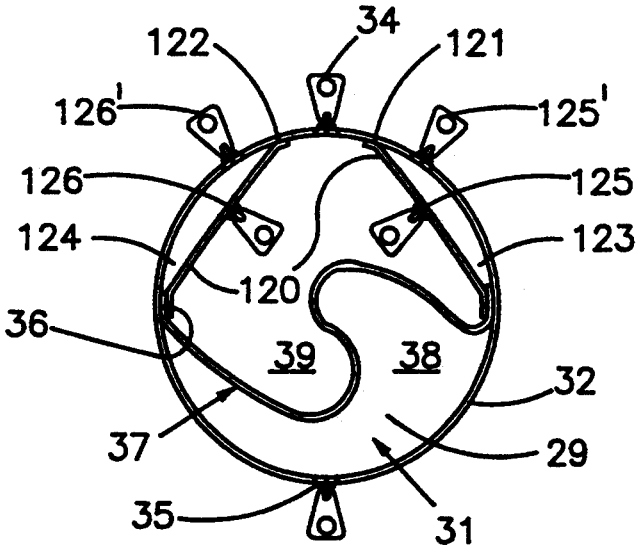
FIG. 20 is a sectional view along line 20—20 of FIG. 19.

In a more preferred embodiment of the preceding carrying bag, the width of dividing member 37 is increased. The same amount of material is used from the center of dividing member 37 to form chambers 38 and 38, as shown in FIG. 19; however, extra material 120, on either side of dividing member 37, is used to form pockets 123 and 124 by sewing or gluing edges 121 and 122 to the interior surface of interior cavity 31. In the particular embodiment shown in FIG. 20, the width of dividing member 37 is approximately doubled, providing enough extra material to allow edges 121 and 122 to be attached along line 127 adjacent zipper 34 as shown in FIG. 19. Also in this particular embodiment zippers 125 and 126 are provided for access through the extra material of dividing member 37 into chambers 123 and 124 respectively, although access could also be provided by zippers 125′ and 126′ through outer containment structure 32.

Figure 3:
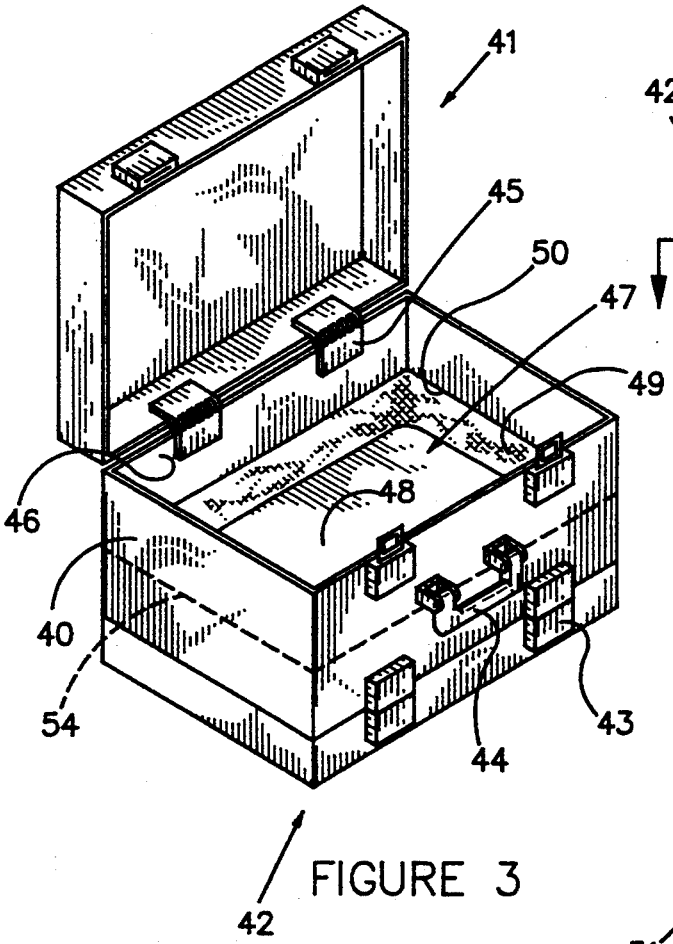
FIG. 3 is a perspective view of a bag embodying another form of the present invention.
Figure 5:
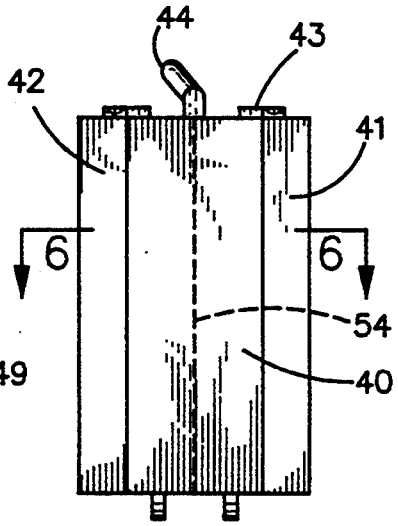
FIG. 5 is a side view of the bag of FIG. 3 with both end-sections closed.
Figure 4:
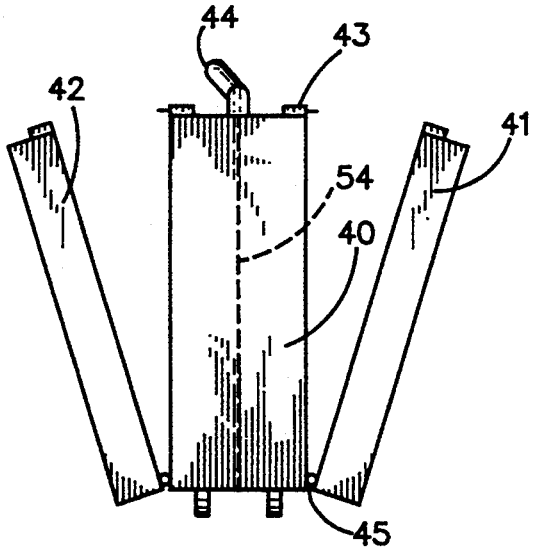
FIG. 4 is a side view of the bag of FIG. 3 with both end-sections opened.

In another embodiment of the present invention, shown in FIG. 3, the containment structure comprises center-section 40, and end-sections 41 and 42. Each of the end-sections is attached to center-section 40 along its lower side by hinges 45. This allows the end-sections to pivot into the opened position, shown in FIG. 4, or the closed position, shown in FIG. 5. When in the closed position the end-sections may be held closed by latches 43. Handle 44 is attached approximately in the middle of the top of center-section 40. Interior cavity 51, shown in FIG. 6, is formed when end-sections 41 and 42 are in the closed position.

Figure 7:
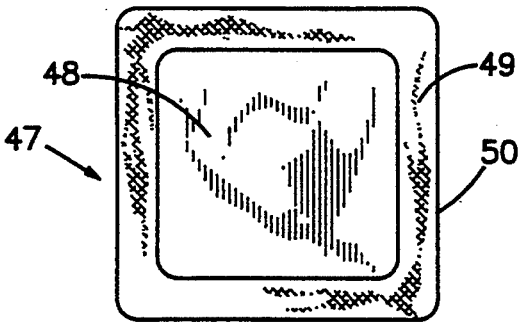
FIG. 7 is a perspective view of the flexible dividing member of the bag of FIG. 3.

In a more preferred embodiment, the dividing member of the invention, generally indicated by the numeral 47 and illustrated in FIG. 7, consists of portion 48 and flexible portion 49. In a particular preferred embodiment, portion 48, constructed of rigid plastic, is generally the same shape as the interior of center-section 40, yet small enough to allow portion 48 to pass freely through the interior of center-section 40. Again, flexible portion 49 is constructed from a material that will prevent odors and/or moisture from passing between chambers 52 and 53. Suitable materials include vinyl, leather, rubberized canvas or other similar material. Flexible portion 49 is larger than portion 48 and is dimensioned such that when portion 48 is positioned in the center of flexible portion 49 there is a flexible border around portion 48 sufficient to allow portion 48 to move freely within the interior of center section 40. In a preferred embodiment the border is an inch and a half larger than one half the width of center-section 40 plus the depth of either end-section 41 or 42.

Figure 6:
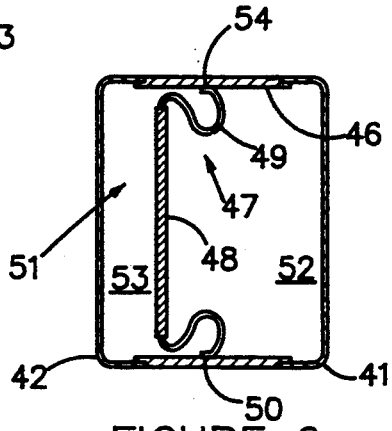
FIG. 6 is a sectional view on the line 6—6 of FIG. 5.

As shown in FIG. 6, outer edge 50 of dividing member 47 is gathered and fixed to interior surface 46 of center-section 40 along circumferential midline 54 creating separate chambers 52 and 53. Chamber 52 is accessible when end-section 41 is in the opened position; chamber 53 is accessible when end-section 42 is in the opened position.

Figure 8:
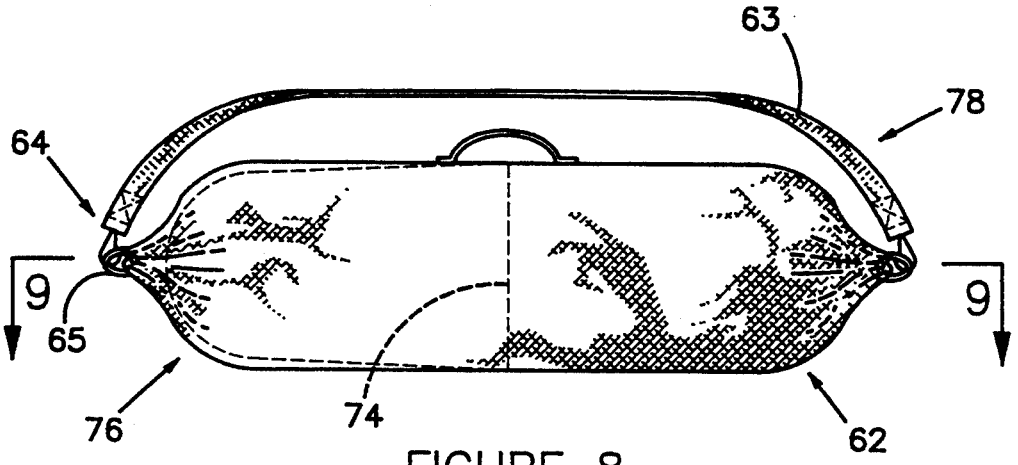
FIG. 8 is a side view of a bag embodying another form of the present invention.
Figure 10:
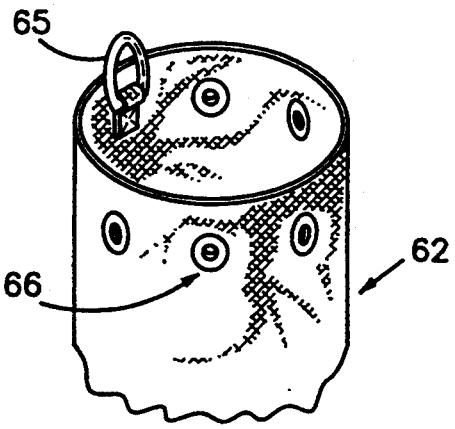
FIG. 10 is perspective view of one end of the bag of FIG. 8 with that end opened.
Figure 11:
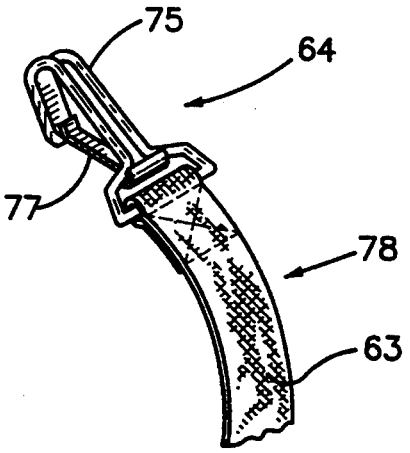
FIG. 11 is a perspective view of one end of the strap of the bag of FIG. 8 showing the snap clasp and the woven strap.

Another embodiment of the present invention is illustrated in FIG. 8. In this embodiment, the containment structure generally indicated by the numeral 62, is constructed of canvas or similar material, and is essentially tubular in shape. One end of tubular shaped containment structure 62 is illustrated in FIG. 10. Grommets 66 in conjunction with metal loops 65 form access portals, generally indicated by the numeral 76, at either end of tubular containment structure 62. The width of metal loop 65 is selected such that metal loop 65 may pass through grommets 66. The length of metal loop 65 is selected such that metal loop 65 may be passed through all of the grommets on a given end and there is still a sufficient length of loop available to receive J-hook 75 of snap clasp 64. Each access portal is closed by passing all the grommets 66 at a given end over the metal loop 65 at that end and then attaching snap clasp 64 to metal loop 65. This is accomplished by depressing locking bar 77 and passing J-hook 75 through metal loop 65.

A carrying strap, generally indicated by the numeral 78, is provide in this embodiment and comprises snap clasp 64 attached at either end of webbed belt 63. In a preferred embodiment webbed belt 63 is constructed of nylon or similar webbing material.

Figure 9:
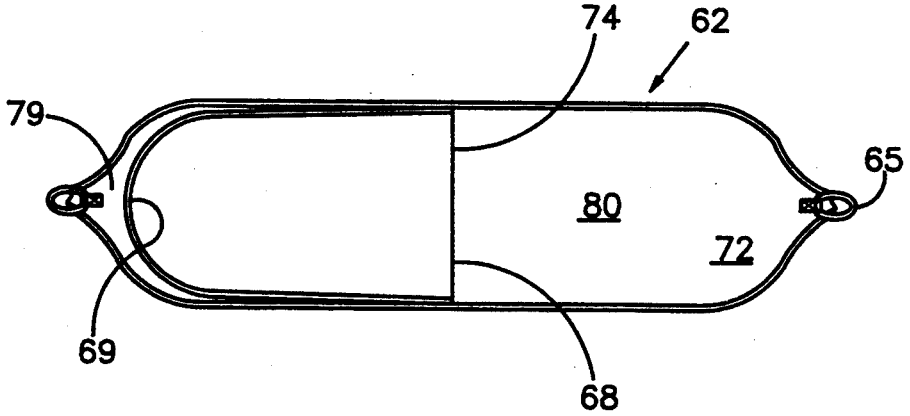
FIG. 9 is a sectional view on the line 9—9 of FIG. 8.
Figure 12:
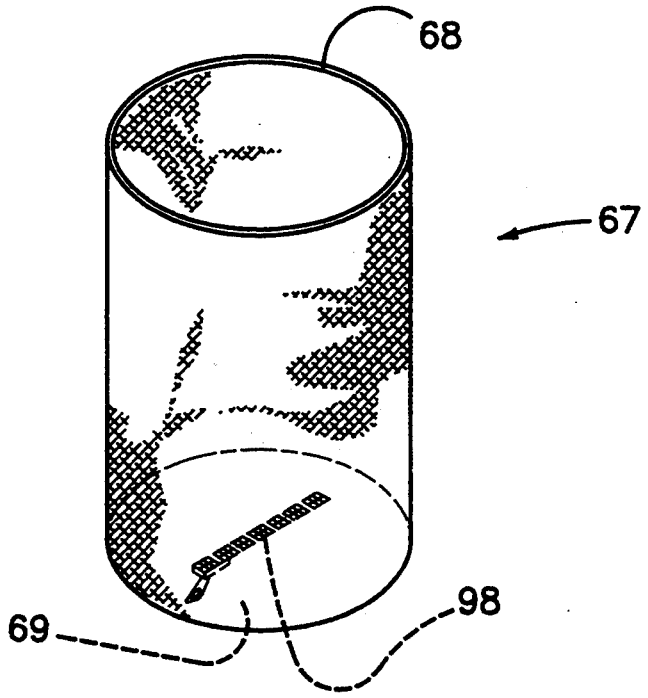
FIG. 12 is a perspective view of the flexible dividing member of the bag of FIG. 8.

Flexible dividing member 67 is illustrated in FIG. 12. It is flexible and substantially cup shaped. Peripheral lip 68 of flexible dividing member 67 is sewn to the surface of sealable interior cavity 72 of tubular containment structure 62 along circumferential midline 74 thereby forming separate chambers 79 and 80. As shown in FIG. 9, flexible dividing member 67 is approximately one half the length of tubular containment structure 62 and equal in diameter. Flexible dividing member 67 has sealable portal 98 through bottom 69. In this embodiment sealable portal 98 is a zipper, however, other forms of sealable portals such as velcro and snaps would be just as suitable. Flexible dividing member 67 is constructed of vinyl, leather, rubberized canvas or other similar material, to prevent the transfer of moisture and odors between separate chambers 79 and 80.

Figure 15:
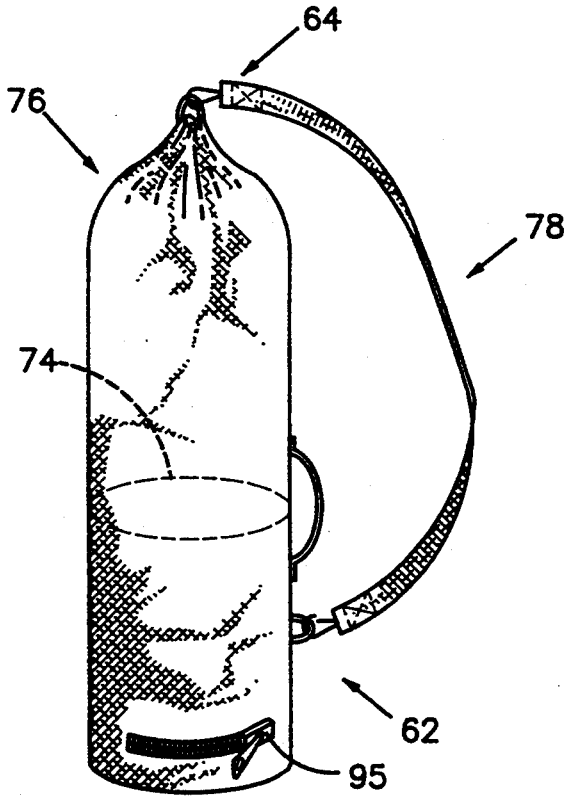
FIG. 15 is a perspective view of a modified version of the bag illustrated in FIG. 8.

A modified version of the bag illustrated in FIG. 8 is illustrated in FIG. 15. As FIG. 15 shows, the modification consists of substituting zippered access portal 95 in the side of containment structure 62 for one of the grommet and metal loop access portals, 76, of the bag illustrated in FIG. 8; and attaching one end of carrying strap 78 to containment structure 62, since the metal loop to which it was attached is no longer present in this modified version.

Figure 21:
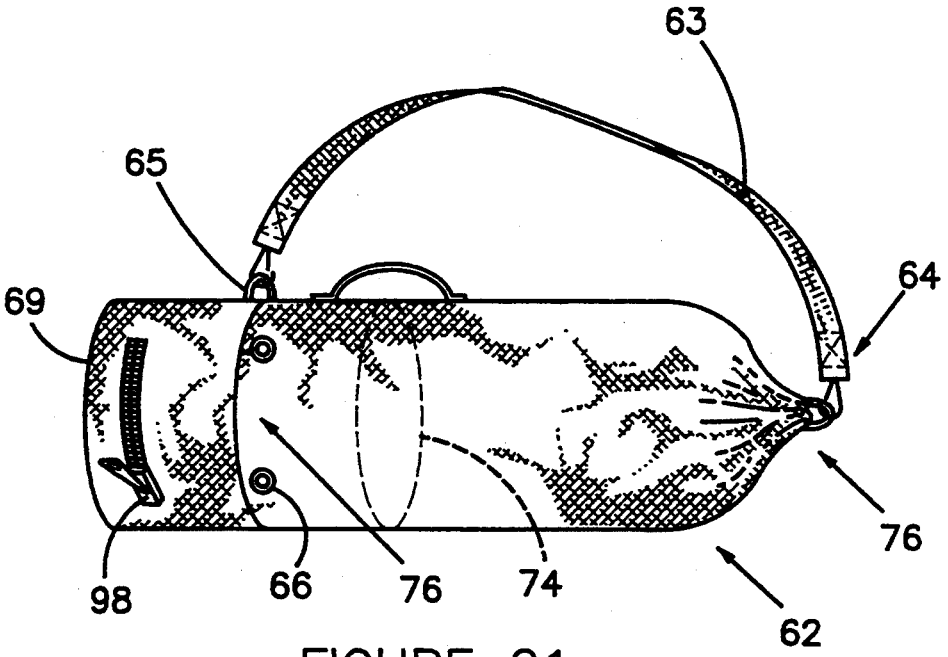
FIG. 21 is perspective view of a modified version of the bag of FIG. 8 with one grommet and metal loop access portal open.

Still another variation of the bag illustrated in FIG. 8 is shown in FIG. 21. As can be seen, flexible dividing member 67 in this variation is adapted such that the volume of separate chambers 79 and 80 is variable between zero and a volume greater than the maximum volume of interior cavity 72 when one of grommet and metal loop access portals 76 is in the opened position.

Figure 13:
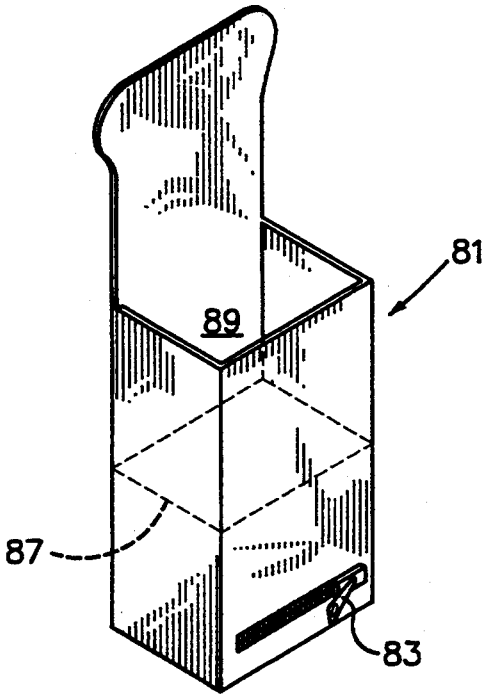
FIG. 13 is a perspective view of a bag embodying another form of the present invention.
Figure 14:
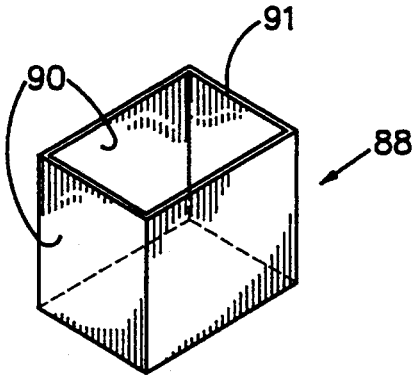
FIG. 14 is a perspective view of the flexible dividing member of the bag of FIG. 13.

Another form of the invention is contained in the bag illustrated in FIG. 13. The bag shown comprises a containment structure, constructed of a material capable of forming a moisture barrier such as vinyl, rubberized sheeting or similar material and generally indicated by the numeral 81; and a flexible dividing member, illustrated in FIG. 14 and generally indicated by the numeral 88. Flexible dividing member 88 has a peripheral lip 91 which in this embodiment is attached to the interior surface of containment structure 81 along circumferential midline 87 forming cavity 89 and a separate chamber 85 formed by interior surface 82 of containment structure 81 and one side 90 of flexible dividing member 88. Cavity 89 is defined along the sides by interior surface 82 of containment structure 81 and at the bottom by one side 90 of flexible dividing member 88. Zipper 83, attached to the bottom half of containment structure 81, provides sealable access to separate chamber 85.

Figure 22:
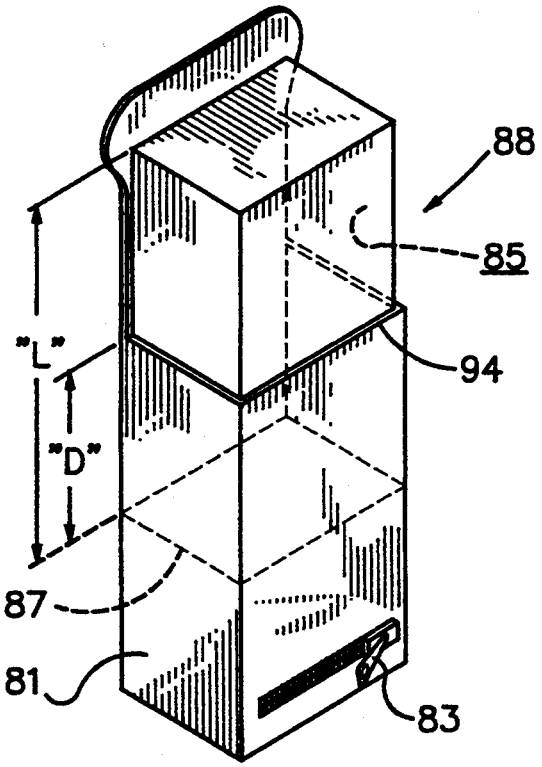
FIG. 22 is a perspective view of a modified version of the bag of FIG. 13 showing the dividing member extending past the containment structure of the bag.

A variation of the bag illustrated in FIG. 13 is shown in FIG. 22. As can be seen, flexible dividing member 88 in this variation is adapted such that the volume of separate chamber 85 is variable between zero and a volume greater than the maximum volume contained by containment structure 81. In a preferred embodiment, this is achieved by proper sizing of flexible dividing member 88. More particularly, flexible dividing member 88 will have a length "L" greater than the distance "D" from the point of attachment "A" of member 88 to structure 81 to the top edge 94 of structure 81. In this embodiment the structure 81 can contain additional items that may be purchased during a trip.

Figure 16:
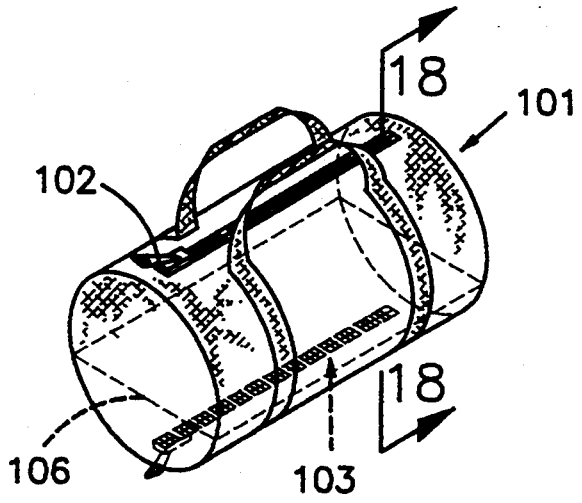
FIG. 16 is a perspective view of bag having an embodiment of the present invention.
Figure 17:
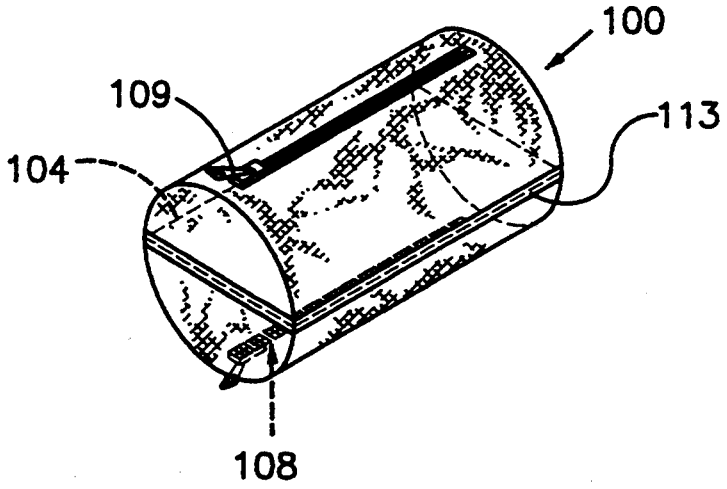
FIG. 17 is a perspective view of an embodiment of the present invention.

Still another carrying bag including an embodiment of the present invention is illustrated in FIG. 16. In this embodiment dividing member 100, illustrated in FIG. 17., is constructed of any material which will serve as an odor barrier, such as canvas, vinyl, rubber and similar materials, and has the same dimensions as containment structure 101. Dividing member 100 also includes a sealable interior chamber 110 which is accessible through either zippered access portals 108 or 109.

Figure 18:
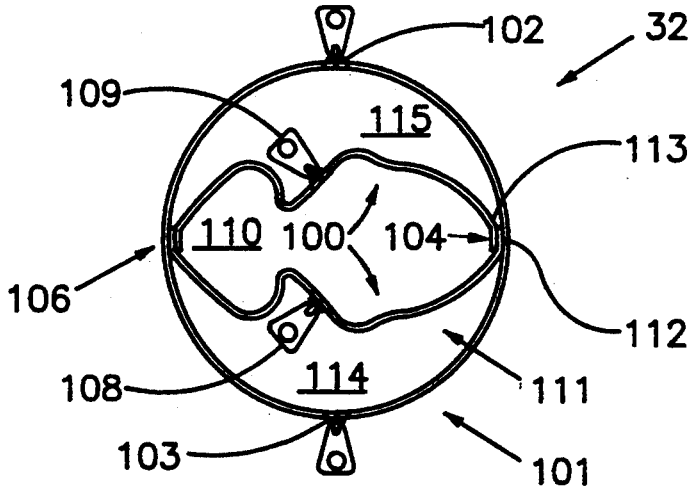
FIG. 18 is a sectional view along line 18—18 of FIG. 16.

As shown in FIG. 18, interior cavity 111 of containment structure 101 has one half of a detachable attachment device 112, such as velcro, secured along circumferential midline 106. Dividing member 100 has the other half of the detachable attachment device 113 secured along its circumferential midline 104. When detachable attachment devices 112 and 113 are attached, dividing member 100 divides interior cavity 111 of containment structure 101 into separate chambers 114 and 115.

The detachability of dividing member 100 allows dividing member 100 to be removed for laundering apart from containment structure 101.

Although particular materials, methods of construction and access portal devices have been described in the foregoing embodiments, it is to be understood that other similar materials, methods of construction and access portal devices are contemplated within the scope of the present invention and that many other embodiments of the present invention will occur to those skilled in the art which are intended to be included within the scope and spirit of the following claims.

I claim:

1. A bag capable of carrying clothing comprising:

a containment structure having walls whose interior surfaces form a sealable interior cavity having a fixed maximum volume, said interior surfaces forming a midline area extending about said cavity wherein approximately half of said fixed maximum volume is on either side of said midline area, said containment structure provided with at least two separate access portals, each of which is separately provided with means to open and close each respective access portal extending through said containment structure to connect said interior cavity to the exterior of said containment structure; and a dividing member fixed to at least one of said interior surfaces of said walls to form a plurality of separate chambers within said interior cavity, each of said separate chambers being accessible through a corresponding one of said access portals sized to permit clothing which may be in one of said chambers to be removed and placed in another of said chambers, said access portals being spaced apart a distance greater than the thickness of said dividing member, said dividing member having a first section and a perimeter section attached to said midline area, at least one of said first section and perimeter section being flexible and sized to enable said dividing member to be positioned adjacent at least a portion of said walls to permit the volume of each of said separate chambers to be varied from about zero to approximately said fixed maximum volume of said interior cavity, wherein the sum of the volumes of said separate chambers is at least approximately equal to said fixed maximum volume.

2. The carrying bag of claim 1 wherein said dividing member is fixed permanently to said interior surfaces.

3. The carrying bag of claim 1 wherein said dividing member is constructed from material which prevents moisture from transfering from one of said chambers to another of said chambers.

4. The carrying bag of claim 1 wherein said dividing member is constructed from material which prevents odor from transfering from one of said chambers to another of said chambers when the pressure differential between said separate chambers is substantially zero.

5. The carrying bag of claim 1 wherein said walls comprise two end walls connected by a side wall to form a cylindrically shaped interior cavity, and wherein said dividing member is attached at about the midline of said cylindrically shaped interior cavity.

6. The carrying bag of claim 1 wherein both said first section and said perimeter section are flexible.

7. The carrying bag of claim 5 or 6 wherein said dividing member is trough-shaped to conform to each half of said cylindrically shaped interior cavity.

* * * * *